US012240637B2

(12) United States Patent
Batavia et al.

(10) Patent No.: US 12,240,637 B2
(45) Date of Patent: Mar. 4, 2025

(54) FOOD CONTAINER EVACUATION SYSTEM COMPRISING A FOOD CONTAINER EVACUATION MODULE AND FOOD CONTAINERS THEREFOR

(71) Applicant: SAES GETTERS S.P.A., Lainate (IT)

(72) Inventors: Marco Filippo Batavia, Lucca (IT); Ginevra Della Porta, Milan (IT); Andrea Cadelli, Cusago (IT); Andrea Conte, Milan (IT)

(73) Assignee: SAES Getters S.p.A., Lainate (IT)

( * ) Notice: Subject to any disclaimer, the term of this patent is extended or adjusted under 35 U.S.C. 154(b) by 0 days.

(21) Appl. No.: 18/567,896

(22) PCT Filed: Jun. 9, 2022

(86) PCT No.: PCT/EP2022/065743
§ 371 (c)(1),
(2) Date: Dec. 7, 2023

(87) PCT Pub. No.: WO2022/258774
PCT Pub. Date: Dec. 15, 2022

(65) Prior Publication Data

US 2024/0262552 A1 Aug. 8, 2024

(30) Foreign Application Priority Data

Jun. 10, 2021 (IT) ..... 102021000015143

(51) Int. Cl.
*B65B 31/04* (2006.01)
*B65D 81/20* (2006.01)

(52) U.S. Cl.
CPC ..... *B65B 31/047* (2013.01); *B65D 81/2038* (2013.01)

(58) Field of Classification Search
USPC ..... 53/79
See application file for complete search history.

(56) References Cited

U.S. PATENT DOCUMENTS 4,051,971 A * 10/1977 Saleri ..... B65D 81/2038 99/476
5,396,751 A * 3/1995 Chi ..... B65B 31/047 53/88

(Continued)

FOREIGN PATENT DOCUMENTS

DE 8321236 U1 2/1984
EP 1092649 A1 4/2001

(Continued)

OTHER PUBLICATIONS

International Preliminary Report on Patentability issued Sep. 27, 2023 in PCT/EP2022/065743, 16 pages.

(Continued)

*Primary Examiner* — Chinyere J Rushing-Tucker
(74) *Attorney, Agent, or Firm* — Element IP, PLC

(57) ABSTRACT

The present invention relates to a food container evacuation module (31) capable of enhanced performances in terms of attainable vacuum and also being portable and easy to use, to a food container evacuation system (300) comprising it and to food containers (33) apt to be used in such food container evacuation system (300).

20 Claims, 3 Drawing Sheets

(56) References Cited

U.S. PATENT DOCUMENTS

Figure 1:
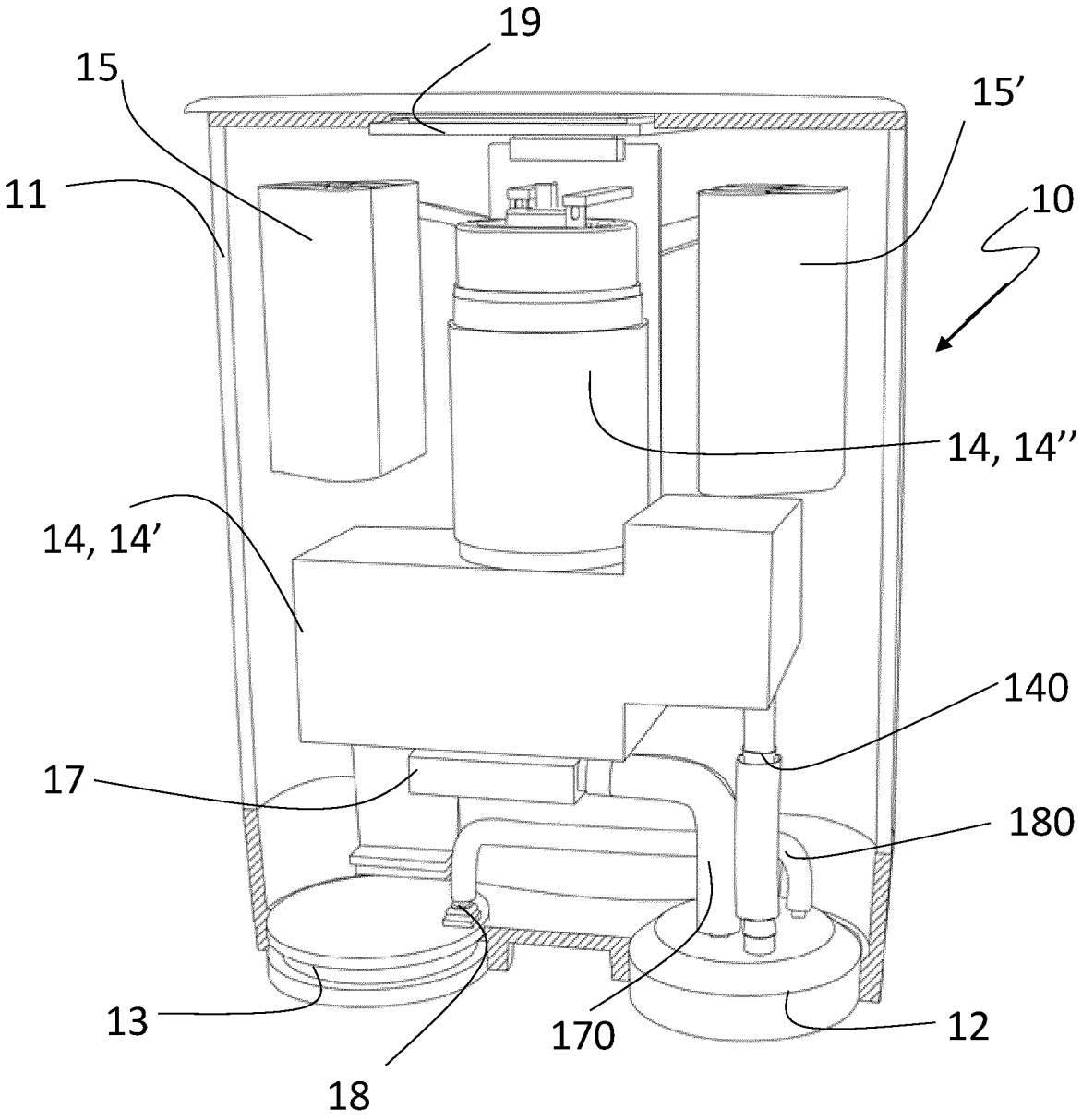

| | | | | |
|---|---|---|---|---|
| 6,391,629 | B1 * | 5/2002 | Jenny | B65B 31/047 141/347 |
| 2005/0061813 | A1 | 3/2005 | Vilalta et al. | |
| 2011/0203222 | A1 * | 8/2011 | Forngren | B65B 31/04 53/79 |
| 2016/0101884 | A1 * | 4/2016 | Picozza | B65B 31/047 53/79 |
| 2021/0155392 | A1 * | 5/2021 | Wang | B65D 51/1683 |

FOREIGN PATENT DOCUMENTS

| | | | | |
|---|---|---|---|---|
| EP | 1990541 | A2 | 11/2008 | |
| WO | WO-9631396 | A1 * | 10/1996 | B65B 31/047 |

OTHER PUBLICATIONS

International Search Report issued Sep. 9, 2022 in PCT/EP2022/065743, 4 pages.
Written Opinion issued Sep. 9, 2022 in PCT/EP2022/065743, 6 pages.

* cited by examiner

FOOD CONTAINER EVACUATION SYSTEM COMPRISING A FOOD CONTAINER EVACUATION MODULE AND FOOD CONTAINERS THEREFOR

The use of vacuum, or to be more precise the use of food containers under a reduced pressure, to improve life and storage of food is generally known since many years, as for example described in U.S. Pat. No. 5,054,266.

While the system detailed in said patent is bulky, portable devices for household use are described in WO 2002/046062, U.S. Pat. Nos. 7,096,893 and 7,389,629.

Needless to say, the lower is the pressure inside the food container the better is the food preservation because aerobic degradation processes are proportional to the concentration of oxygen in the container. In this regard, it is noteworthy to mention that most of the food vacuum systems for domestic use are capable to achieve limited vacuum levels, i.e. in the order of 400-500 mbar (40000-50000 Pascal).

Also, an additional limit inherent with portable systems of the known art is the coupling of the vacuuming unit with the container to be evacuated. Such operation sometimes is often not totally straightforward, as a vertically elongated element needs to be coupled in a tight manner to the lid valve in an essentially perpendicular plane (the container lid). To avoid missteps in the coupling, great attention must be paid, especially during the start-up phase, to the positioning of the vacuum module on the food container. This problem can be overcome with the use of mechanical constraints that guarantee a correct coupling and thus allow the system to function, these mechanical constraints being usually movable and subject to wear.

Better performing evacuation equipment loses the portability requirement due to the weight of components, with particular reference to the weight of the vacuum pump, such systems being typically resident systems with a large rectangular base.

Purpose of the present invention is to overcome the drawbacks of the known art with a portable system capable to achieve a higher degree of vacuum in food containers, and in a first aspect thereof consists in a food container evacuation module comprising a case containing a vacuum pump with a suction head, wherein in the bottom portion of the food container evacuation module there are means for coupling the vacuum pump suction head with a food container, the vacuum pump weight being comprised between 100 g and 600 g and its pumping flow rate being at least 0.2 l/min at a residual pressure of 20000 Pascal, wherein the case is inscribable in a box with height comprised between 10 cm and 25 cm, width comprised between 5 cm and 15 cm, depth comprised between 3 cm and 7 cm, and two circular protrusions, whose diameter is comprised between 10 mm and 80 mm and height is comprised between 3 mm and 50 mm, are present at the bottom of the case and are not taken into account for the dimensions of the above-mentioned box. Preferably the evacuation module of the present invention comprises a vacuum pump having a flow rate of at least 0.1 l/min at 15000 Pascal.

The term "inscribable in a box" with certain dimensions indicates that the case stays/is contained in such box.

The combination of the technical features of a food container evacuation module according to the present invention allows to achieve heightened operational performances combined with system portability and ease of use, in terms of reliable coupling between the evacuation module and the food container to be evacuated.

The combination of pump weight and pump flow rate at a given operating pressure are elements that allows a person skilled in the art to unambiguously identify a suitable pump for reducing to practice the present invention by simply looking at the information provided by the vacuum pump manufacturer, usually in the pump manual.

Figure 2:
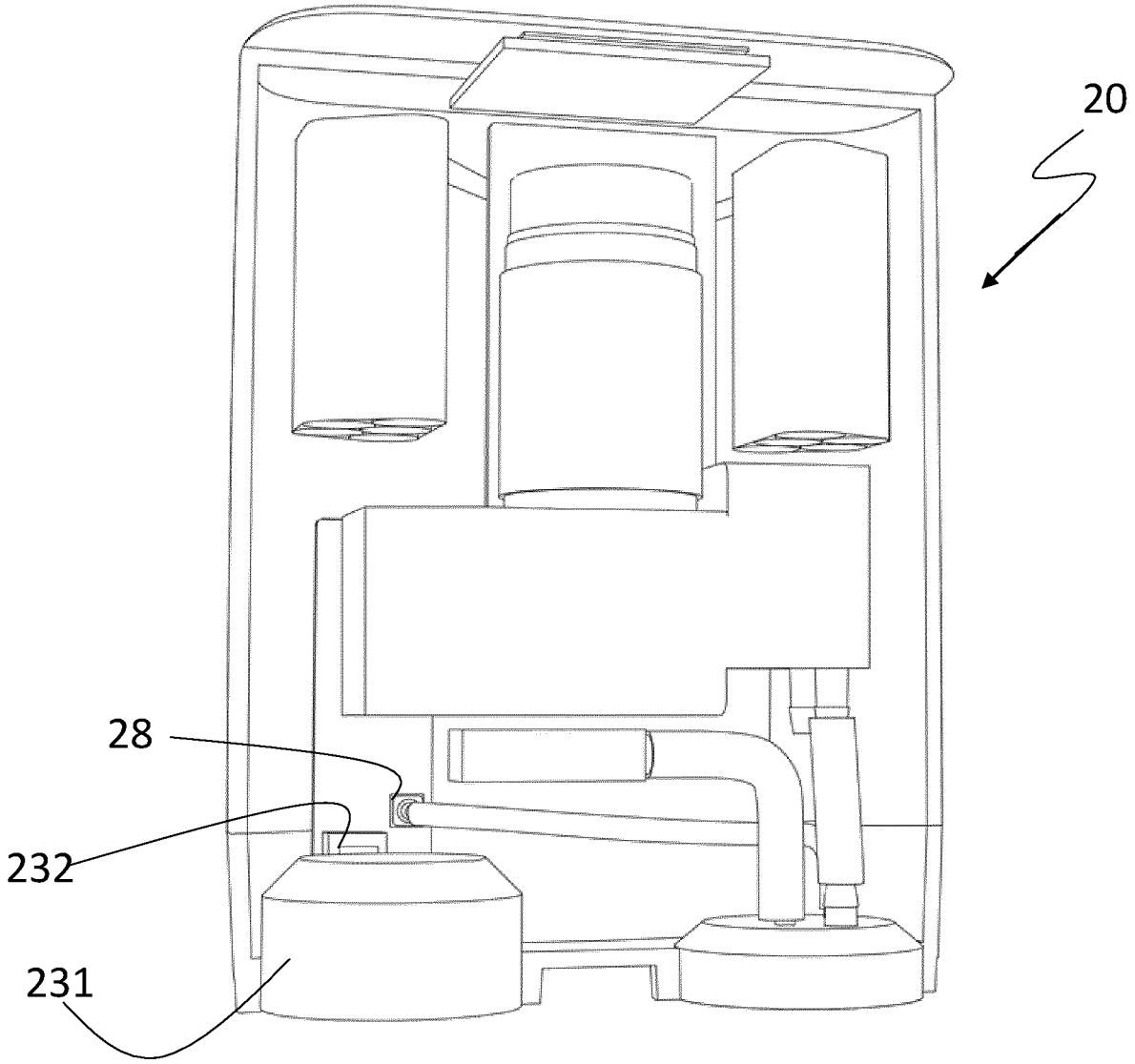
Figure 3:
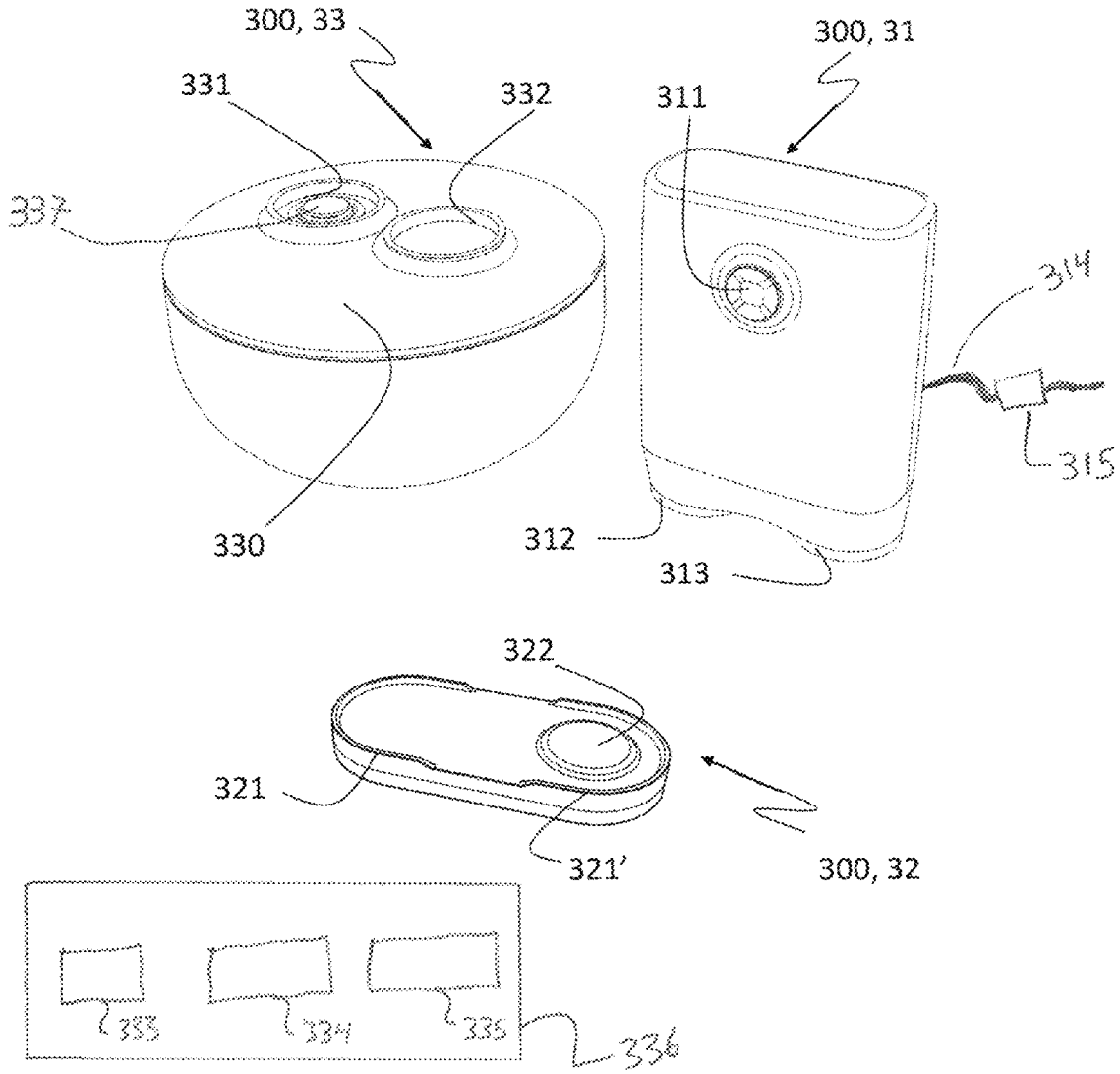

The invention will be further illustrated with the help of the following figures where:

FIG. 1 is a schematic representation of the broken view of a food container evacuation module according to a most preferred embodiment of the present invention, FIG. 2, is a schematic representation of the broken view of a food container evacuation module according to a second embodiment of the present invention, and FIG. 3 is a perspective view of a food evacuation system according to a preferred embodiment of the present invention.

It is to be underlined that the above figures are representative schematics and views and as such dimensions or dimensional ratios are to be considered merely indicative of a certain element, component, module, system according to the present invention.

Moreover, some ancillary elements, such as electric tracks and circuitry, have not been represented as they are not essential to illustrate and understand the core of the invention and its underlying principle.

FIG. 1 shows a broken view of a first embodiment of a food container evacuation module 10 according to the present invention that comprises a case 11 shaped somewhat like binoculars in its lower part, with two circular elements 12, 13 protruding from the bottom of case 11. Circular elements 12, 13 act as interfacing elements with the outside environment and each fulfills a different function.

Circular element 12 is suitable for coupling with a matching valve on a lid of a food container to be evacuated. It is to be remarked that its detailed structure and the means for coupling with a suitable food container to be evacuated are not the subject of the present invention as they are widely known to a person skilled in the art, as described for example in the aforementioned WO 2002/046062 and U.S. Pat. No. 7,096,893. In the following, the circular element 12 will be also equivalently defined as "vacuuming interface".

Circular element 13 comprises a receiver suitable for coupling with a recharge base to charge rechargeable batteries 15, 15'. It is to be remarked that the detailed structure and coupling means for charging batteries 15, 15' as well as the charging control routine are not the subject of the present invention as they are widely known to a person skilled in the art and widely diffused in the telecommunication sector for mobile phones charging, as described for example in US 2012/249064. In the following, the circular element 13 will be also equivalently defined as "charging interface".

Needless to say, within case 11 there is a suitable electric circuit (not shown) to deliver electrical current to rechargeable batteries 15, 15' that supply current to a T-shaped pump 14 and to a display 19 for showing the operating status of module 10 as well as other useful information, for example vacuum level and battery level. Batteries 15, 15' also provide current to the control electronics module, a printed circuit board (PCB) present within the module (not shown).

Preferably the control electronics module should be able to switch between two operational modes, a standard mode when the food container evacuation module is operated at full vacuuming capacity, i.e. the residual pressure in the coupled container reaches about 50 mbar (5000 Pascal), and a "soft vacuum", when the residual pressure stays at about 200 mbar (20000 Pascal). Such dual operational mode enables for more versatility and allows use with "soft shell" food, such as berries.

For the higher pressure operation, a system according to present invention, i.e. comprising a pump with a flow rate of at least 0.2 l/min at a residual pressure of 20000 Pascal, ensures that the target pressure is reached in a short time. This is a secondary advantage of the present invention, with respect to the main advantage associated with the standard mode, i.e. the capability of reaching 50 mbar in less than 1 minute.

Pump 14 is composed by two main parts, i.e. motor 14" and suction head 14', and a connecting pipe 140 puts in communication the suction head 14' with the vacuuming interface 12. Batteries 15, 15' also provide current to a relief valve 17 that is also connected to the vacuuming interface 12 through a connecting pipe 170 to allow disengagement of the coupled food container once the proper vacuum level is reached. Such vacuum level can be measured by a pressure transducer 18 connected through a pipe 180 to the vacuuming interface 12. Relief valve 17 may be automatically or manually controlled, and in the case of automatically controlled relief valves the preferred ones are those based on shape memory alloy (SMA) wires, solenoid valves or piezoelectric valves.

As mentioned, the invention is characterized by the use of a specific class of pump allowing to achieve superior vacuum levels and being compact and light, more specifically pumps that according to their specification have a pumping flow rate of at least 0.2 l/min at a residual pressure of 20000 Pascal.

Such feature can be easily verified by curves typically provided with the pump itself or by connecting the pump to a suitable test bench. In this regard, the pump requirements are met if at a residual pressure of 20000 Pascal or below (in a real environment it is not meaningful to express an absolute pressure value as testing condition) the pumping flow rate is no less than 0.2 l/min, preferably no less than 0.1 l/min at 15000 Pascal. An alternate method to verify if a pump is suitable to be used is to verify if during an evacuation cycle from atmospheric pressure the data point at 20000 Pascal, directly measured or as extrapolated by the flow/pressure curve, provides a pumping flow rate of at least 0.2 l/min, or preferably the data point at 15000 Pascal provides a pumping flow rate of at least 0.1 l/min.

The invention is not limited to a specific type of pump as long as it fulfills the above specified condition on flow rate at a certain pressure level, even though preferred pumps are the so called double head T-diaphragm pumps, single head L-shaped pumps, rolling diaphragm pumps and linear diaphragm pumps. Moreover such pumps shall also satisfy the condition of having their weight comprised between 100 g and 600 g.

With reference to the material of case 11, it is preferable to use plastics, more preferably acrylonitrile butadiene styrene plastic (ABS) or polycarbonate (PC). The preferred solution is such that the case shape and the plastic materials of choice are optimized for an injection molding process, those specified above being the preferred materials, even though a person skilled in the art knows immediately how to select other variants, see for example the paper "The impact of polymer selection and recycling on the sustainability of injection moulded parts" by Vassallo et al, published on Procedia CIRP, Volume 90, 2020, Pages 504-509.

Preferably, case 11 has an internal support structure designed in nylon reinforced with glass fiber, preferably in an amount comprised between 15 wt % and 35 wt % (calculated over the weight of the support structure), because it is the best solution to combine strength and vibration absorption. Variants could comprise as constituting material recycled plastics, bioplastics, steel, aluminum alloys or wood because they could be advantageous in terms of different characteristics, such as wear resistance, lightness, strength, sustainability/recyclability.

More in detail, in order to maintain optimal easy handling and portability of the food container evacuation module 10, the overall weight of the components, excluding the vacuum pump, should be comprised between 250 g and 400 g.

For the same reason, the shape of case 11 is inscribable in a box with height comprised between 10 cm and 25 cm, width comprised between 5 cm and 15 cm, depth comprised between 3 cm and 7 cm. Two circular protrusions with diameter comprised between 10 mm and 80 mm and height comprised between 3 mm and 50 mm project from the bottom part of case 11 (i.e. the part for food container coupling) and are not taken into account for the dimensions of the above-mentioned box.

The case shape may vary as long as it fulfills the above geometric requirements, even though preferred is the use of a rounded shape for easier handling and the one resembling a pair of binoculars in the lower part is the most preferred one.

It is to be underlined that the food container evacuation module 10 described in FIG. 1 is a preferred embodiment according to the present invention, its essential features being recited in the first claim of the present application, all the other features being optional or easily modifiable by a person of ordinary skill in the art without departing from the scope of the invention.

In this regard, the pressure transducer 18, whose preferred operating range is 0-100000 Pascal, is to be considered an optional element since the pressure level could be determined, albeit less precisely, from the power absorbed by the vacuum pump (the lower the pressure, the lower the absorbed current) or by evaluation based on the vacuum pump operation time.

The preferred way to recharge the rechargeable batteries, whose energy is preferably comprised between 1-20 Wh and more preferably between 2 and 15 Wh is the one outlined in FIG. 3, i.e. through inductive wireless charging. Alternately, a proper socket could be present in case 11 for power supply through a cable via a suitable voltage transformer. This allows also for the module operation when the batteries are depleted or for an alternate (and lighter) embodiment with no resident rechargeable batteries, although this cancels the system portability due to the power cable connection constraints.

The present invention is not limited to a specific type of display, even though the preferred one is an organic light-emitting device (OLED). Also, in some alternate embodiments the display can be replaced with other types of communicating elements and interfaces, such as LED lights with different color indicators, sound type communications, haptic feedbacks.

The module turning on operation may be achieved through a button or similar mechanical mechanism (lever, mechanical switch) or via a touchscreen display. Turning off may be both manually set or automatically driven once proper vacuum is achieved in the food container connected to the food container evacuation module. At the same time, module 10 may present some other additional elements, for example a vacuum pump muffler may be added depending on the noise during operation of the vacuum pump.

Also, another optional element is a port for connecting with the vacuum pump suction head a piping element external to the module case, for evacuation of a deformable food containing element (i.e. plastic sachet/bag) or more generally coupling with a valve for different types of food containers.

A schematic representation of the broken view of a second embodiment of a food container evacuation module 20 according to the present invention is shown in FIG. 2. The main difference with respect to FIG. 1 is that the charging interface 13 has been replaced with a gas bottle 231 whose opening and closing is controlled by an electronic driver 232, while the rechargeable batteries can be recharged via a suitable socket in the food container evacuation module case for connection to the mains, allowing for its portability and use without the need of having a proximity with a mains socket.

The gas bottle 231 is refillable or replaceable and its volume is preferably comprised between 5 $cm^3$ and 20 $cm^3$. A replaceable bottle more easily allows for inserting into the food container different gases and so tailor the protective modified atmosphere to the food to preserve, preferred gases to be used for such purposes being nitrogen, carbon dioxide, argon and their mixtures. Some information on the role of different gases together with vacuuming for food preservation can be found, for example, in the chapter "Modified atmospheres and vacuum packaging" of the book "Food Preservatives" by A. R. Davies.

In addition, the pressure transducer 28 is located in a different position and the container to be coupled to module 20 shall obviously present a suitable interface for fluid-tight coupling with the gas bottle 231.

In a second aspect thereof the invention is inherent to a food container evacuation system 300 as shown in FIG. 3, comprising a power supply module 32, a food container evacuation module 31 having a power cord 314 and a transformer 315 and a food container 33, which may be part of a kit 336 of food containers composed by a first container 333, second container 334 and third container 335, said evacuation module 31 comprising a case containing a vacuum pump with a suction head, wherein in the bottom portion of the case there are means for coupling the vacuum pump suction head with the food container 33. This system 300 is characterized in that the vacuum pump weight is comprised between 100 g and 600 g and the vacuum pump pumping flow rate is at least 0.2 l/min at a residual pressure of 20000 Pascal (i.e. is the same as in evacuation module 10), and in that the food container 33 has a first and second protruding coupling circles 331, 332 on its lid 330, wherein the height of said circles is comprised between 3 mm and 10 mm, and has a port 337 capable of communicating with the suction head to form an external vacuum piping connection therewith.

The evacuation module 31 has an on/off button 311, and in the lower part are present a vacuuming interface 312 and a charging interface 313.

The first coupling circle 331 on the food container lid 330 is for active vacuuming of the food container 33, meaning that it presents suitable elements to put in fluid communication the food container atmosphere with the vacuum pump suction head in a safe and efficient manner. Namely, it presents a non-return valve capable of preventing the unwanted entry of air into the food container 33, for example during the disengagement of the evacuation module 31 from the food container via relief valve actuation, and at the same time prevents any spill-out in the evacuation module 31 from the food container 33 during evacuation.

In the preferred embodiment, the ventilation of container 33 is done directly through the evacuation valve, that can be opened allowing ambient air to enter when the food is to be consumed/accessed. In this regard, the preferred solution envisions the use of lifting mechanisms, such as straps, to allow the entry of air, as described in WO 2002/046062.

The second coupling circle 332 of the food container lid 330 is simply a lid protrusion in order to provide mechanical stability to the vacuum system during operation through mechanical coupling with charging interface 313 of the evacuation module 31. Needless to say, the internal diameter of the coupling circles 331, 332 must substantially match the external diameter of the vacuuming interface 312 and of the charging interface 313 respectively.

The wireless charging base 32 has an inductive charging element 322 for suitable coupling and energy transmission to charging interface 313 of the evacuation module 31. Moreover it presents raised edges 321, 321' on its extremities to hold in place the evacuation module 31 during charging.

A variant of system 300 uses the evacuation module 20 shown in FIG. 2, whereby the system does not include a wireless charging base, but possibly a support base. In this variant, the second coupling circle 332 is replaced with a suitable fluid-tight interface for the injection of a gaseous protective atmosphere during the connection with the gas bottle 231 in the evacuation module 20 and subsequent container sealing after its disconnection. The advantages of combining vacuum and a modified atmosphere for food preservation are for example described in U.S. Pat. No. 8,240,158.

With regard to the power source for the food container evacuation system according to the present invention, it could be a transformer to allow for direct connection to the voltage mains or, as already outlined, a battery pack contained in the evacuation module to be coupled with a recharging base, preferable a wireless recharging base, or to be charged via the above-mentioned transformer.

In a third aspect thereof, the invention consists in a food container suitable to be coupled with a food container evacuation module according to the present invention, said container including a lid and having an inner volume comprised between 0.2 and 2 liters.

The lid of the food container is preferably circular with a diameter between 100 and 220 mm and has a convex shape to improve resistance to the pressure levels reached inside it. The lid has two circular outward protrusions matching the position and outside diameter of the evacuation module charging interface and vacuuming interface, said protrusions having the function of reinforcing the lid structure by acting as a structural reinforcing rib, in addition to the function of improving the coupling between the evacuation module and the container.

It is to be underlined that the present invention is not limited to any lid material nor to any specific lid thickness, as long as the lid is able to sustain the pressure difference between the external environment and the evacuated container. Such combination of parameters is readily ascertainable by a person skilled in the art, taking into account the ultimate vacuum level within the food containers and reasonable thicknesses. The most useful materials have a flexural strength comprised between 30 MPa and 300 MPa. In a preferred embodiment, lids are made with a plastic material, whose minimum thickness is chosen depending on the material flexural strength, starting from about 1 mm for the more robust materials.

The minimum thickness of the lid is usually in correspondence of indentations to accommodate the two food container evacuation module protrusions.

Preferably, the container is part of a kit of food containers composed by a first, second and third container, with the first container having a lid diameter comprised between 180 and 220 mm and inner volume comprised between 1.3 and 2.0 liters, the second container having a lid diameter comprised between 150 and 180 mm and inner volume comprised between 0.75 and 1.0 liters, and the third container having a lid diameter comprised between 100 mm and 150 mm and inner volume comprised between 0.2 and 0.5 liters.

The invention claimed is:

1. A food container evacuation module comprising a case with a top portion and a bottom portion, the case containing a vacuum pump with a suction head, wherein in the bottom portion of said case there are means for coupling said suction head with an evacuation valving means located on the lid of a container, wherein the weight of said vacuum pump is comprised between 100 g and 600 g and its pumping flow rate is at least 0.2 l/min at a residual pressure of 20000 Pascal, the case being inscribable in a box with a height comprised between 10 cm and 25 cm, a width comprised between 5 cm and 15 cm, and a depth comprised between 3 cm and 7 cm, and wherein two circular protrusions, whose diameter is comprised between 10 mm and 80 mm and whose height is comprised between 3 mm and 50 mm being are present at the bottom of the case and not taken into account for the dimensions of the box.

2. The food container evacuation module according to claim 1, wherein the pumping flow rate is at least 0.1 l/min at a residual pressure of 15000 Pascal.

3. The food container evacuation module according to claim 1, wherein the vacuum pump is chosen from double head T-diaphragm pumps, single head L-shaped pumps, rolling diaphragm pumps, linear diaphragm pumps.

4. The food container evacuation module according to claim 1, wherein the cumulative weight of all the elements of the food container-evacuation with the exception of the vacuum pump is comprised between 250 g and 400 g.

5. The food container evacuation module according to claim 1, wherein it includes one or more rechargeable battery packs, optionally with an energy comprised between 1 and 20 Wh.

6. The food container evacuation module according to claim 1, wherein it comprises a pressure transducer, optionally such pressure transducer operating in the 0-100000 Pascal pressure range.

7. The food container evacuation module according to claim 1, wherein it comprises a valve to automatically vent the suction head, such valve being chosen from shape memory alloy wire controlled valves, solenoid valves and piezoelectric valves.

8. The food container evacuation module according to claim 1, wherein it comprises a display, optionally on the top portion of the case.

9. The food container evacuation module according to claim 1, wherein said evacuation valving means located on the lid of the container comprises a port capable of communicating with the suction head to form an external vacuum piping connection therewith.

10. The food container evacuation module according to claim 1, wherein it comprises a gas bottle with means for coupling to a food container, the internal volume of said gas bottle being comprised between 5 $cm^3$ and 20 $cm^3$.

11. The food container evacuation module according to claim 1, wherein the material of the case comprises plastics, optionally acrylonitrile butadiene styrene plastic or polycarbonate.

12. The food container evacuation module according to claim 1, wherein the case has an internal support structure designed in nylon reinforced with glass fiber, optionally in an amount comprised between 15 wt % and 35 wt %.

13. A food container evacuation system comprising:

a power supply module, a food container evacuation module according to claim 1, a food container with a lid, with a first and second protruding coupling circles on said lid, wherein the height of said circles is comprised between 3 mm and 10 mm.

14. The food container evacuation system according to claim 13, wherein the first coupling circle is for the evacuation of the food container and the second coupling circle is for mechanical coupling with the evacuation module.

15. The food container evacuation system according to claim 13, wherein the first coupling circle is for the evacuation of the food container and the second coupling circle is for introducing in the food container a gas or gas mixture coming from the food container evacuation module.

16. The food container evacuation system according to claim 13, wherein the power supply module is a wireless charger suitable to be coupled to the food container evacuation module and provided at the bottom with a charging interface.

17. The food container evacuation system according to claim 13, wherein it comprises a power cord and transformer for the food container evacuation module.

18. A food container for coupling with a food container evacuation module according to claim 1, wherein it includes a circular lid with a diameter comprised between 100 mm and 220 mm and inner volume comprised between 0.2 and 2 liters.

19. The food container according to claim 18, wherein it comprises on its lid a first and second protruding coupling circles, wherein the height of said circles is comprised between 3 mm and 10 mm.

20. The food container according to claim 18, wherein said food container is one of a kit of three containers having the following features:

a first container has a lid diameter comprised between 180 and 220 mm and inner volume comprised between 1.3 and 2.0 liters, a second container has a lid diameter comprised between 150 and 180 mm and inner volume comprised between 0.75 and 1.0 liters, a third container has a lid diameter comprised between 100 mm and 150 mm and inner volume comprised between 0.2 and 0.5 liters.

* * * * *